US012753960B2

(12) United States Patent
Gorman et al.

(10) Patent No.: US 12,753,960 B2
(45) Date of Patent: Oct. 6, 2026

(54) AUTOCASCADE SYSTEM WITH SUPERHEAT CONTROL

(71) Applicant: TRANE INTERNATIONAL INC., Davidson, NC (US)

(72) Inventors: Daniel Gorman, La Crosse, WI (US); Stephen A. Kujak, Brownsville, MN (US); Logan Stephenson, La Crosse, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 255 days.

(21) Appl. No.: 18/587,334

(22) Filed: Feb. 26, 2024

(65) Prior Publication Data

US 2025/0271188 A1 Aug. 28, 2025

(51) Int. Cl.

| | |
|---|---|
| ***F25B 49/02*** | (2006.01) |
| ***F25B 7/00*** | (2006.01) |
| ***F25B 31/00*** | (2006.01) |

(52) U.S. Cl.

CPC ..... *F25B 49/02* (2013.01); *F25B 7/00* (2013.01); *F25B 31/004* (2013.01); *F25B 2400/23* (2013.01); *F25B 2600/2513* (2013.01); *F25B 2700/00* (2013.01); *F25B 2700/04* (2013.01); *F25B 2700/1933* (2013.01); *F25B 2700/21151* (2013.01)

(58) Field of Classification Search

CPC ..... F25B 49/02; F25B 7/00; F25B 31/004; F25B 2400/23; F25B 2600/2513; F25B 2700/10; F25B 2700/04; F25B 2700/1933; F25B 2700/21151

See application file for complete search history.

(56) References Cited

U.S. PATENT DOCUMENTS

| | | | |
|---|---|---|---|
| 6,405,554 | B1 | 6/2002 | Kawakatu et al. |
| 6,609,390 | B1 | 8/2003 | Ueno et al. |
| 7,469,542 | B2 | 12/2008 | Kalina |
| 9,989,280 | B2 | 6/2018 | Ali |
| 10,001,310 | B2 | 6/2018 | Takayama et al. |

(Continued)

FOREIGN PATENT DOCUMENTS

| | | | |
|---|---|---|---|
| CN | 114893923 | B | 5/2023 |
| CN | 115289703 | B | 10/2023 |

(Continued)

OTHER PUBLICATIONS

JP_H09119720 translation.*

Extended European Search Report, European Patent Application No. 25159636.7, Jul. 18, 2025 (10 pages).

*Primary Examiner* — Elizabeth J Martin

(74) *Attorney, Agent, or Firm* — HSML P.C.

(57) ABSTRACT

An autocascade heat transfer fluid circuit includes one or more concentration sensors. The concentration sensors allow the determination of a current composition of a blended working fluid containing multiple components that separate during operation of the autocascade heat transfer fluid circuit. The current composition allows determination of a dew point for the current composition, and a superheat can be calculated based on the determined dew point and pressure and temperature readings. The determined superheat can in turn be used to control operations of the autocascade heat transfer fluid circuit by control of an expander thereof.

16 Claims, 2 Drawing Sheets

(56) References Cited

U.S. PATENT DOCUMENTS

| | | | |
|---|---|---|---|
| 10,077,924 | B2 | 9/2018 | Takayama et al. |
| 10,132,539 | B2 | 11/2018 | Sugimoto et al. |
| 10,656,110 | B2 | 5/2020 | Higashida et al. |
| 11,137,185 | B2 | 10/2021 | Farrar et al. |
| 2012/0216551 | A1 | 8/2012 | Minor et al. |
| 2023/0324084 | A1 | 10/2023 | Maynard |

FOREIGN PATENT DOCUMENTS

| | | | |
|---|---|---|---|
| JP | H09-119720 | A | 5/1997 |
| WO | 2023/192569 | A1 | 10/2023 |

* cited by examiner

AUTOCASCADE SYSTEM WITH SUPERHEAT CONTROL

FIELD

This disclosure is directed to heat pump systems, particularly autocascade heat pump systems that determine a superheat based on a dew point that is in turn based on a refrigerant blend determined using one or more sensors.

BACKGROUND

Autocascade refrigerant circuits can offer high lift in heating or cooling applications. Autocascade refrigerant cycles use a blended refrigerant that separates into liquid and vapor streams, and the composition of this blend can change during operations.

SUMMARY

This disclosure is directed to heat pump systems, particularly autocascade heat pump systems that determine a superheat based on a dew point that is in turn based on a refrigerant blend determined using one or more sensors.

By using concentration sensors to determine concentrations of one of more of the components of a working fluid, the current composition flowing through the circuit can be determined. From this composition, a dew point of the current composition can be determined, and a suction superheat can also be determined, despite the variable composition of the working fluid in circulation over time that exists in autocascade systems. In embodiments, the refrigerant blend and/or the number and type of concentration sensors can be selected to allow the determination of the current composition of working fluid in the circuit. This can in turn allow for superheat-based control to be applied even to such autocascade systems. Accordingly, control of autocascade systems can be improved and the use of autocascade systems, which can offer high lift, achieve low temperatures, and be simpler and more efficient than systems having multiple discrete working fluid circuits in cascade relationships, can become more widespread.

In an embodiment, a heat transfer fluid circuit includes a compressor configured to compress a working fluid. The working fluid includes a plurality of components. The heat transfer fluid circuit further includes a condenser, a liquid-vapor separator, downstream of the condenser, and a cascade heat exchanger. The cascade heat exchanger has a first side configured to receive the vapor phase of the working fluid from the liquid-vapor separator and a second side configured to receive a liquid phase of the working fluid. The circuit also includes a subcooler, an expander located between the subcooler and an evaporator, and the evaporator. The circuit further includes a temperature sensor, a pressure sensor, one or more concentration sensors; and a controller. The controller is configured to receive concentrations from each of the one or more concentration sensors, determine a composition of the working fluid at the one or more concentration sensors, obtain a dew point of the working fluid based on the composition of the working fluid at the one or more concentration sensors, and determine a superheat based on the dew point, a temperature from the temperature sensor, and a pressure from the pressure sensor. The controller is further configured to control the heat transfer fluid circuit based on the superheat.

In an embodiment, the working fluid has two components.

In an embodiment, the circuit includes a concentration sensor for each of a plurality of the components of the working fluid.

In an embodiment, the temperature sensor, the pressure sensor, and the one or more refrigerant concentration sensors are located at or directly upstream of a suction of the compressor.

In an embodiment, the circuit further includes a lubricant separator downstream of the compressor and upstream of the condenser.

In an embodiment, the circuit further includes a liquid level sensor at the liquid-vapor separator.

In an embodiment, control of the heat transfer fluid circuit based on the superheat includes controlling the expander.

In an embodiment, the circuit further includes a second expander located between a liquid side of the liquid-vapor separator and the cascade heat exchanger. In an embodiment, control of the heat transfer fluid circuit based on the superheat includes controlling the second expander.

In an embodiment, a method for operating a heat transfer fluid circuit includes measuring, using one or more concentration sensors, a concentration of at least one component of a working fluid of an autocascade heat transfer fluid circuit. The method further includes determining a composition of the working fluid, based on the concentration of the at least one component of the working fluid. The method also includes obtaining a dew point of the working fluid based on the composition of the working fluid. The method includes obtaining a temperature of the working fluid. The method further includes determining a superheat based on the dew point and the temperature, and controlling the heat transfer fluid circuit based on the determined superheat.

In an embodiment, controlling the heat transfer fluid circuit includes controlling at least one expander of the heat transfer fluid circuit.

In an embodiment, obtaining the temperature of the working fluid includes measuring the temperature using a temperature sensor positioned directly upstream or directly downstream of the one or more concentration sensors.

In an embodiment, obtaining the pressure of the working fluid includes measuring the pressure using a pressure sensor positioned directly upstream or directly downstream of the one or more concentration sensors.

In an embodiment, the one or more concentration sensors are positioned at or directly upstream of a suction of a compressor of the heat transfer fluid circuit. In an embodiment, the controlling of the heat transfer fluid circuit is based on a target suction superheat value for the heat transfer fluid circuit.

In an embodiment, the method further includes obtaining a pressure of the working fluid, and wherein the dew point is determined further based on the pressure of the working fluid.

DRAWINGS

DETAILED DESCRIPTION

This disclosure is directed to heat pump systems, particularly autocascade heat pump systems that determine a superheat based on a dew point that is in turn based on a refrigerant blend determined using one or more sensors.

As used herein, a "vapor" or "gaseous" phase of the working fluid is the working fluid in a predominantly gaseous form, though it is understood that some liquid can remain present in such working fluid, for example due to incomplete separation or subsequent partial condensation. The liquid can be present in the predominantly vapor or gaseous phase as, for example, entrained droplets or the like.

As used herein, a "liquid" phase of the working fluid is the working fluid in a predominantly liquid form, though it is understood that some gas or vapor can be present in such working fluid, for example due to incomplete separation, subsequent evaporation or incomplete condensation of the working fluid, or the like.

As used herein, "directly" upstream or downstream means that no other components of a fluid circuit, other than fluid lines for conveying the fluid are provided between such directly related elements. As used herein, "upstream" and "downstream" are defined with respect to the direction of flow of the working fluid or a component thereof through the fluid circuit.

Figure 1:
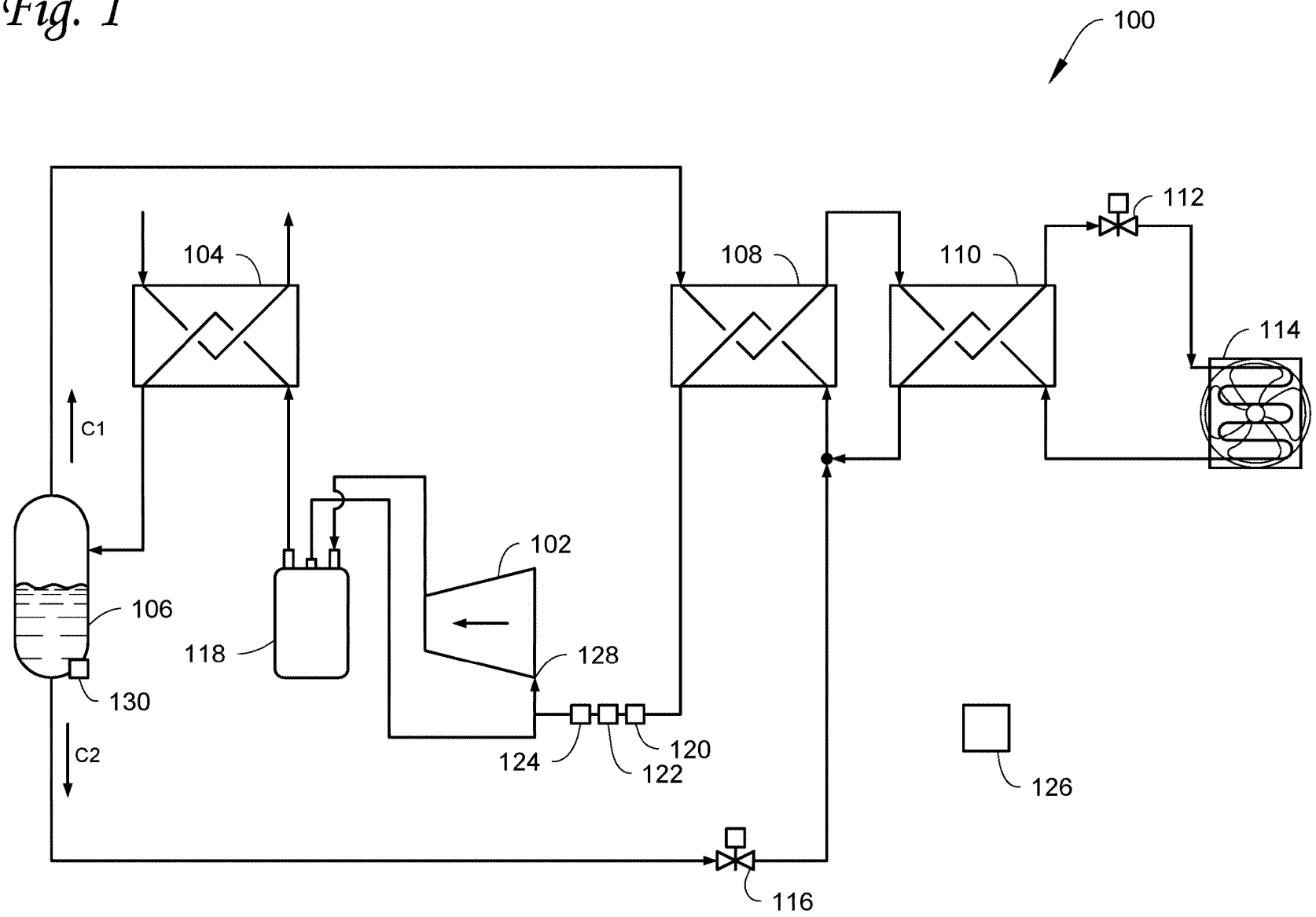
FIG. 1 shows a schematic of an autocascade system according to an embodiment.

FIG. 1 shows a schematic of an autocascade system according to an embodiment. Autocascade system 100 includes compressor 102, condenser 104, liquid-vapor separator 106, cascade heat exchanger 108, subcooler 110, first expander 112, evaporator 114. Autocascade system 100 further includes one or more concentration sensor(s) 120, temperature sensor 122, pressure sensor 124, and controller 126.

In an embodiment, additional suitable components of an autocascade circuit can further be included, for example second expander 116 and lubricant separator 118.

Autocascade system 100 is configured to circulate a working fluid including a plurality of components. In an embodiment, the working fluid is a binary system having two components. In an embodiment, the working fluid includes three or more components. The components of the working fluid can be any suitable components such as various refrigerant compositions or the like. Non-limiting examples of components of the working fluid include R1234ze(E) and carbon dioxide. The working fluid can be composed such that the working fluid separates into liquid and vapor phases downstream of the compressor 102. The components of the working fluid can have different boiling points from one another. The autocascade system 100 can be configured to allow the liquid and vapor phases to exchange heat with one another as an element of the autocascade operation. In the autocascade system 100, the separated flows of working fluid can be recombined, with the complete blend exchanging heat with the vapor phase at cascade heat exchanger 108. In certain but not necessarily all embodiments, autocascade system 100 can include additional liquid-vapor separators 106, such that autocascade system 100 can further concentrate low boiling point fluids in the working fluid supplied to evaporator 114.

Compressor 102 is configured to compress the working fluid. Compressor 102 can be any suitable type of compressor for compressing the working fluid of autocascade system 100, with non-limiting examples including screw compressors, scroll compressors, centrifugal compressors, or the like. The compressor 102 compresses components of the working fluid received at a suction 128.

The compressed working fluid passes to condenser 104. At condenser 104 the compressed working fluid rejects heat, for example to an ambient environment in a cooling application, a hot water supply loop or a heating coil for heating air, or any other suitable medium to which heat can be rejected. From the condenser 104, the condensed working fluid then passes to liquid-vapor separator 106, where the respective gaseous and liquid portions of the condensed working fluid are separated into first and second portions of the working fluid. The liquid-vapor separator can include a liquid level sensor 130 to measure the amount of liquid contained in liquid-vapor separator 106. While the portions of the working fluid are referred to as "gaseous" or "vapor" and "liquid", it is understood that separation at liquid-vapor separator 106 is not complete 100% separation, and some liquid will be present in the gaseous/vapor phase working fluid and some gas or vapor will be present in the liquid phase working fluid. Each portion of the working fluid will predominantly include the respective phase by which it is referred to.

A first component of the working fluid C1 can pass from the liquid-vapor separator 106 to cascade heat exchanger 108. Cascade heat exchanger 108 is configured to allow the vapor component from liquid-vapor separator 106 to exchange heat with the second component C2 flowing from one or both of the second expander 116 and the subcooler 110. The working fluid leaving the cascade heat exchanger 108 can pass to the suction 128 of compressor 102. In an embodiment, the exchange of heat at cascade heat exchanger 108 cools the first component from the liquid-vapor separator 106.

Subcooler 110 is configured to allow the exchange of heat between the first component leaving cascade heat exchanger 108 and the first component as it leaves the evaporator 114. The subcooler 110 can thereby further cool the first component prior to passing to the first expander 112.

First expander 112 is configured to expand the received first component of the working fluid. Expander 112 can be any suitable one or more expansion valves, nozzles, orifices, combinations thereof, or the like. In an embodiment, the first expander 112 is a controllable expander, for example an electronic expansion valve (EXV). The first component can then pass from first expander 112 to evaporator 114. At evaporator 114, the expanded first component can absorb heat, for example to provide cooling to a fluid, such as air of an environment to be cooled, a process fluid, or the like. The first component can then pass through subcooler 110 to cool the first component on an opposite side of the subcooler 110, upstream of the first expander 112 as discussed above. The first component that has passed through the subcooler 110 after leaving evaporator 114 can then join a flow of the second component from second expander 116 to in turn flow through cascade heat exchanger 108 to the suction 128 of the compressor 102.

Second expander 116 is configured to expand the second component of the working fluid. Second expander 116 can be any suitable one or more expansion valves, nozzles, orifices, combinations thereof, or the like. In an embodiment, the second expander 116 is a controllable expander, for example an electronic expansion valve (EXV). The second component of the working fluid can be received at second expander 116 from the liquid-vapor separator 106. The second component of the working fluid can, after leaving second expander 116, join the flow of the first component leaving subcooler 110, and then flow through cascade heat exchanger 108 to the suction 128 of the compressor 102.

Lubricant separator 118 can be provided downstream of compressor 102. Lubricant separator 118 can be any suitable separator for removing at least some lubricant from working fluid passing through the lubricant separator 118. The lubricant can be lubricant for the compressor 102 that has become dissolved in or entrained in the working fluid.

One or more concentration sensor(s) 120 can be included along the flow path for the working fluid. The one or more concentration sensor(s) 120 can each be any suitable chemical concentration sensor, analyzer, or the like capable of determining a concentration of a component of the working fluid. In an embodiment, the one or more concentration sensors are provided at or near suction 128 of the compressor 102. In an embodiment, the one or more concentration sensor(s) 120 are located directly upstream of suction 128 of the compressor 102. In an embodiment, the one or more concentration sensor(s) 120 are located between an outlet of the cascade heat exchanger 108 and suction 128 of compressor 102. In an embodiment, each of the one or more concentration sensor(s) 120 is directed to a different component of the working fluid of autocascade system 100. In an embodiment, a specific concentration sensor 120 is provided for all of or all but one of the components of the working fluid. The one or more concentration sensor(s) 120 are configured to measure the concentration of the respective component of the working fluid and to report the concentration value to controller 126. The concentration sensor(s) 120 can be connected to the controller 126 by any suitable wired or wireless communications. In embodiments, the concentration sensor(s) 120 can be positioned at any other suitable location for determining a superheat suitable for control of the autocascade system 100, such as a discharge of the compressor 102 or the like.

Temperature sensor 122 is a temperature sensor configured to measure a temperature of the working fluid. The temperature sensor 122 can be positioned at or near the position of the concentration sensor(s) 120. In an embodiment, the temperature sensor 122 is provided at or near suction 128 of the compressor 102. In an embodiment, the temperature sensor 122 is located directly upstream of suction 128 of the compressor 102. In an embodiment, the temperature sensor 122 is located between an outlet of the cascade heat exchanger 108 and suction 128 of compressor 102. The temperature sensor 122 is configured to measure the temperature of the respective component of the working fluid and to report the concentration value to controller 126. The temperature sensor 122 can be connected to the controller 126 by any suitable wired or wireless communications. In embodiments, the temperature sensor 122 can be positioned at any other suitable location for determining a superheat value suitable for control of the autocascade system 100, such as a discharge of the compressor 102 or the like.

Pressure sensor 124 is a pressure sensor configured to measure a pressure of the working fluid. The pressure sensor 124 can be positioned at or near the position of the concentration sensor(s) 120. In an embodiment, the pressure sensor 124 is provided at or near suction 128 of the compressor 102. In an embodiment, the pressure sensor 124 is located directly upstream of suction 128 of the compressor 102. In an embodiment, the pressure sensor 124 is located between an outlet of the cascade heat exchanger 108 and suction 128 of compressor 102. The pressure sensor 124 is configured to measure the pressure of the working fluid and to report the pressure value to controller 126. The pressure sensor 124 can be connected to the controller 126 by any suitable wired or wireless communications. In embodiments, the pressure sensor 124 can be positioned at any other suitable location for determining a superheat suitable for control of the autocascade system 100, such as a discharge of the compressor 102 or the like.

Controller 126 is configured to receive the measurements from the one or more concentration sensor(s) 120, the temperature sensor 122, and the pressure sensor 124, and to control one or more components of the autocascade system 100, including but not limited to compressor 102, first expander 112, and/or second expander 116. The controller 126 can be configured to determine a current composition of the working fluid from the one or more concentration sensor(s) 120. The current composition can be determined entirely based on the measurements from the one or more concentration sensor(s) 120 when the concentration sensor(s) 120 measure concentrations for each component of the working fluid. In an embodiment, the concentration sensor(s) 120 can use an ultrasonic approach to determine concentrations based on pressure, temperature, and a speed of sound by determining such values and mapping those parameters to refrigerant concentrations based on a suitable function. In embodiments, other sensors can be used as concentration sensor(s) 120 for measuring concentrations directly, with a non-limiting example being a non-dispersive infrared (NDIR) sensor. Where a component is not measured by the one or more concentration sensors, the concentration of the non-measured component can be determined arithmetically by finding the remainder after subtracting all measured concentrations from the total of the working fluid. The current composition can then be used to identify a dew point for the current composition of the working fluid. The dew point can be obtained from a lookup table, determined based on known properties of the respective components of the working fluid, or the like, calculated based on a function, or the like. In an embodiment, the dew point is further based on the pressure measured by pressure sensor 124. In an embodiment, the dewpoint is an output of a polynomial function based on the composition and the pressure. Based on the dew point and the temperature, a superheat value for the working fluid can be determined. In an embodiment, the controller 126 can further be configured to control the autocascade system based on the determined superheat. The control can be, for example, to achieve a target superheat value, to maintain superheat within a range of permissible values, or any other suitable control loop where the superheat is a variable used for control. The control can include control of one or more of, for example, compressor 102, first expander 112, and/or second expander 116 according to effects on the superheat value so as to raise or reduce the superheat to achieve the target value, enter or stay within the desired and/or permissible range of values, or the like. The control can be implemented by any suitable controls, actuators, or the like included in the respective controlled elements of the autocascade system 100. In embodiments, combinations of components can be controlled in concert, for example the first expander 112 and the second expander 116 (when present). In an embodiment, the first expander 112 can be controlled to modify the superheat and the second expander 116 can be controlled to adjust a level in liquid-vapor separator 106 such that the relative concentrations of working fluid components can be changed, for example to achieve a target value for a particular component.

Figure 2:
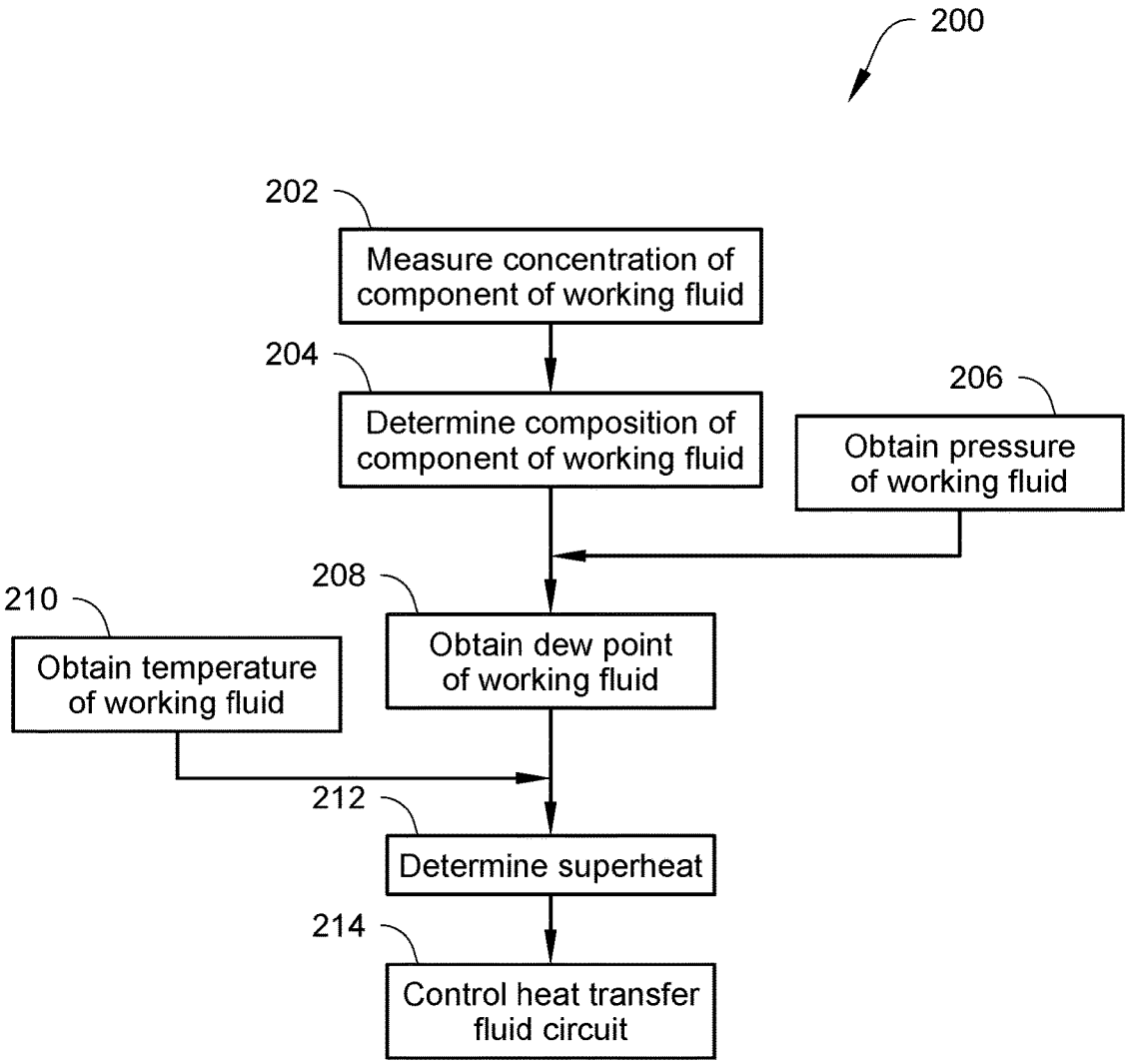
FIG. 2 shows a method of controlling an autocascade system according to an embodiment.

FIG. 2 shows a method of controlling an autocascade system according to an embodiment. Method 200 includes measuring a concentration of at least one component of a working fluid of an autocascade heat transfer fluid circuit 202, determining a composition of the working fluid 204, and obtaining a pressure of the working fluid 206. Method 200 further includes obtaining a dew point of the working fluid 208. The method 200 further includes obtaining a temperature of the working fluid 210, and determining a superheat 212. Method 200 also includes controlling the heat transfer fluid circuit based on the determined superheat 214.

A concentration of at least one component of a working fluid of an autocascade heat transfer fluid circuit is measured at 202. Each of the at least one component(s) can be, for example, one of a plurality of refrigerant compositions included in the working fluid of the autocascade heat transfer fluid circuit. The concentration or concentrations measured at 202 can be measured so as to determine a present composition of the working fluid. The concentrations can be measured using one or more suitable concentration sensors. In an embodiment, a dedicated concentration sensor specific to each of the measured components of the working fluid is used for the measurement(s) of the concentrations of the components of the working fluid at 202. In an embodiment, the concentration sensor(s) are provided at or directly upstream of a suction of the compressor.

The composition of the working fluid is determined at 204. In an embodiment, the composition of the working fluid is determined based directly on the concentrations measured at 202, for example when every component of the working fluid is measured by a corresponding concentration sensor. In an embodiment, the composition of the working fluid is determined based on one or more concentration values for some of components of the working fluid, and assigning a remainder portion of the concentrations of the working fluid to a known but not measured component of the working fluid. For example, in a binary system where the working fluid has two components, the concentration of one component can be measured at 202 and the remaining component is in turn determined from the measured concentration of the other component at 204. In an embodiment where the working fluid has three components the concentration of two components can be measured at 202 and the remaining component can in turn be determined mathematically from the measured concentrations of the other components at 204. For working fluids having more than three components, the composition of the working fluid can be based on N−1 measured concentrations, where N is the number of components of the working fluid, and the concentration of the remaining component can then be obtained mathematically.

A pressure of the working fluid is obtained at 206. The pressure can be obtained at 206 using any suitable pressure sensor for measuring a pressure of the working fluid. The pressure can be obtained at 206 at a location at or close to the location of the concentration sensors used for the measurement at 202. In an embodiment, the pressure can be obtained at or directly upstream of a suction of a compressor of the heat transfer fluid circuit.

A dew point of the working fluid is obtained at 208. The dew point is based on the composition determined at 204 and optionally the pressure determined at 206. The dew point can be obtained by calculation using the concentrations of the components determined at 204, referring to a lookup table based on the concentrations of the components determined at 204, or any other suitable method for obtaining a dew point for the composition of the working fluid as determined at 204.

A temperature of the working fluid is obtained at 210. The temperature can be obtained at 210 using any suitable temperature sensor for measuring a temperature of the working fluid. The temperature can be obtained at 210 at a location at or close to the location of the concentration sensors used for the measurement at 202. In an embodiment, the temperature can be obtained at or directly upstream of a suction of a compressor of the heat transfer fluid circuit.

Based on the dew point obtained at 208 and the temperature obtained at 210 a superheat value is determined at 212. In an embodiment, the superheat value determined at 212 is a suction superheat value for a compressor of the heat transfer fluid circuit. The suction superheat determined at 212 is accurate for the particular composition of the working fluid at the time of the dew point being obtained at 208 and the temperature being obtained at 210 since the composition and thus the dew point of the working fluid can change over the course of operations of the heat transfer fluid circuit due to the multiple components of the working fluid and the autocascade design of the heat transfer fluid circuit.

The heat transfer fluid circuit can be controlled based on the determined superheat 214. For example, one or more expanders of the heat transfer fluid circuit, such as first expander 112 and/or second expander 116 (when present) can be controlled to adjust an aperture size, rate of flow therethrough, or the like based on the determined superheat. In an embodiment, the expander(s) can be controlled to achieve a target superheat value, to maintain the superheat value within a range or according to one or more threshold values, or the like. In an embodiment, other components of the heat transfer fluid circuit, such as compressor 102, other valves, or the like can also be controlled at 214 based on the determined superheat. In an embodiment, the control at 214 can include modifying an evaporator fan speed.

Aspects

It is understood that any of aspects 1-9 can be combined with any of aspects 10-15.

Aspect 1. A heat transfer fluid circuit, comprising:

a compressor configured to compress a working fluid, the working fluid including a plurality of components;

a condenser;

a liquid-vapor separator, downstream of the condenser;

a cascade heat exchanger, the cascade heat exchanger having a first side configured to receive the vapor from the liquid-vapor separator and a second side configured to receive a liquid phase of the working fluid;

a subcooler;

an evaporator;

an expander located between the subcooler and the evaporator;

a temperature sensor;

a pressure sensor;

one or more concentration sensors; and a controller, configured to:

receive concentrations from a sensor of the one or more concentration sensors;

determine a composition of the working fluid therefrom;

obtain a dew point of the working fluid based on the composition determined;

determine a superheat based on the dew point, a temperature from the temperature sensor, and a pressure from the pressure sensor; and control the heat transfer fluid circuit based on the superheat.

Aspect 2. The heat transfer fluid circuit according to aspect 1, wherein the working fluid has two components.

Aspect 3. The heat transfer fluid circuit according to aspect 1, comprising a concentration sensor for each component of the plurality of components of the working fluid.

Aspect 4. The heat transfer fluid circuit according to any of aspects 1-3, wherein the temperature sensor, the pressure sensor, and the one or more concentration sensors are located at or directly upstream of a suction of the compressor.

Aspect 5. The heat transfer fluid circuit according to any of aspects 1-4, further comprising a lubricant separator downstream of the compressor and upstream of the condenser.

Aspect 6. The heat transfer fluid circuit according to any of aspects 1-5, further comprising a liquid level sensor at the liquid-vapor separator.

Aspect 7. The heat transfer fluid circuit according to any of aspects 1-6, wherein control of the heat transfer fluid circuit based on the superheat includes controlling the expander.

Aspect 8. The heat transfer fluid circuit according to any of aspects 1-7, further comprising a second expander located between a liquid side of the liquid-vapor separator and the cascade heat exchanger.

Aspect 9. The heat transfer fluid circuit according to aspect 8, wherein control of the heat transfer fluid circuit based on the superheat includes controlling the second expander.

Aspect 10. A method for operating a heat transfer fluid circuit, comprising:

measuring, using one or more concentration sensors, a concentration of at least one component of a working fluid of an autocascade heat transfer fluid circuit;

determining a composition of the working fluid, based on the concentration of the at least one component of the working fluid;

obtaining a dew point of the working fluid based on the composition of the working fluid;

obtaining a temperature of the working fluid;

determining a superheat based on the dew point, the temperature, and the pressure; and controlling the heat transfer fluid circuit based on the determined superheat.

Aspect 11. The method according to aspect 10, wherein controlling the heat transfer fluid circuit includes controlling at least one expander of the heat transfer fluid circuit.

Aspect 12. The method according to any of aspects 10-11, wherein obtaining the temperature of the working fluid includes measuring the temperature using a temperature sensor positioned directly upstream or directly downstream of the one or more concentration sensors.

Aspect 13. The method according to any of aspects 10-12, wherein obtaining the pressure of the working fluid includes measuring the pressure using a pressure sensor positioned directly upstream or directly downstream of the one or more concentration sensors.

Aspect 14. The method according to any of aspects 10-13, wherein the one or more concentration sensors are positioned at or directly upstream of a suction of a compressor of the heat transfer fluid circuit.

Aspect 15. The method according to aspect 14, wherein the controlling of the heat transfer fluid circuit is based on a target suction superheat value for the heat transfer fluid circuit.

Aspect 16. The method according to any of aspects 10-15, further comprising obtaining a pressure of the working fluid, and wherein the dew point is determined further based on the pressure of the working fluid.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A heat transfer fluid circuit, comprising:

a compressor configured to compress a working fluid, the working fluid including a plurality of components;

a condenser;

a liquid-vapor separator, downstream of the condenser;

a cascade heat exchanger, the cascade heat exchanger having a first side configured to receive a first portion C1 of the working fluid from the liquid-vapor separator and a second side configured to receive a liquid phase of the working fluid;

a subcooler disposed directly downstream of the cascade heat exchanger to receive the first portion C1 from the cascade heat exchanger;

an evaporator configured to receive the first portion C1 from the subcooler, wherein at the subcooler, the first portion C1 from the evaporator exchanges heat with the first portion C1 from the cascade heat exchanger, and wherein at the cascade heat exchanger, a second portion C2 of the working fluid from the liquid-vapor separator combined with the first portion C1 from the subcooler exchanges heat with the first portion C1 from the liquid-vapor separator;

an expander located between the subcooler and the evaporator;

a temperature sensor;

a pressure sensor;

one or more concentration sensors; and a controller, configured to:

receive concentrations from a sensor of the one or more concentration sensors;

determine a composition of the working fluid therefrom;

obtain a dew point of the working fluid based on the composition determined;

determine a superheat based on the dew point, a temperature from the temperature sensor, and a pressure from the pressure sensor; and control the heat transfer fluid circuit based on the superheat.

2. The heat transfer fluid circuit of claim 1, wherein the working fluid has two components.

3. The heat transfer fluid circuit of claim 1, comprising a concentration sensor for each component of the plurality of components of the working fluid.

4. The heat transfer fluid circuit of claim 1, wherein the temperature sensor, the pressure sensor, and the one or more concentration sensors are located at or directly upstream of a suction of the compressor.

5. The heat transfer fluid circuit of claim 1, further comprising a lubricant separator downstream of the compressor and upstream of the condenser.

6. The heat transfer fluid circuit of claim 1, further comprising a liquid level sensor at the liquid-vapor separator.

7. The heat transfer fluid circuit of claim 1, wherein control of the heat transfer fluid circuit based on the superheat includes controlling the expander.

8. The heat transfer fluid circuit of claim 1, further comprising a second expander located between a liquid side of the liquid-vapor separator and the cascade heat exchanger.

9. The heat transfer fluid circuit of claim 8, wherein control of the heat transfer fluid circuit based on the superheat includes controlling the second expander.

10. A method for operating the heat transfer fluid circuit of claim 1, the method comprising:

measuring, using the one or more concentration sensors, a concentration of at least one component of the working fluid of the heat transfer fluid circuit;

determining the composition of the working fluid, based on the concentration of the at least one component of the working fluid;

obtaining the dew point of the working fluid based on the composition of the working fluid;

obtaining a temperature of the working fluid;

determining the superheat based on the dew point and the temperature; and controlling the heat transfer fluid circuit based on the determined superheat.

11. The method of claim 10, wherein controlling the heat transfer fluid circuit includes controlling at least one expander of the heat transfer fluid circuit.

12. The method of claim 10, wherein obtaining the temperature of the working fluid includes measuring the temperature using a temperature sensor positioned directly upstream or directly downstream of the one or more concentration sensors.

13. The method of claim 10, wherein obtaining the pressure of the working fluid includes measuring the pressure using a pressure sensor positioned directly upstream or directly downstream of the one or more concentration sensors.

14. The method of claim 10, wherein the one or more concentration sensors are positioned at or directly upstream of a suction of a compressor of the heat transfer fluid circuit.

15. The method of claim 14, wherein the controlling of the heat transfer fluid circuit is based on a target suction superheat value for the heat transfer fluid circuit.

16. The method according to claim 10, further comprising obtaining a pressure of the working fluid, and wherein the dew point is determined further based on the pressure of the working fluid.

* * * * *